US008978164B2

(12) United States Patent
Jones et al.

(10) Patent No.: US 8,978,164 B2
(45) Date of Patent: Mar. 17, 2015

(54) WADER PANTS SYSTEM WITH INFLATABLE MEMBRANES

(76) Inventors: Seth Thomas Jones, Russellville, AR (US); Christopher Michael Cooper, Conway, AR (US)

( * ) Notice: Subject to any disclaimer, the term of this patent is extended or adjusted under 35 U.S.C. 154(b) by 368 days.

(21) Appl. No.: 13/541,816

(22) Filed: Jul. 5, 2012

(65) Prior Publication Data

US 2014/0007318 A1 Jan. 9, 2014

(51) Int. Cl.
*A41D 13/012* (2006.01)

(52) U.S. Cl.
USPC ..... 2/82; 2/227; 441/91; 36/29; 36/89; 36/109; 36/117.6

(58) Field of Classification Search
CPC ... A41D 13/012; A41D 13/0125; B63C 9/105
USPC ..... 36/4, 7.3, 109, 93, 136, 117.6, 89, 29; 2/69, 227, 243.1, 82, 46, 79, 2.11, 901, 2/DIG. 3, DIG. 5, 2.14; 441/90, 91, 102, 441/109
See application file for complete search history.

(56) References Cited

U.S. PATENT DOCUMENTS

| | | | | |
|---|---|---|---|---|
| 3,888,242 | A * | 6/1975 | Harris et al. | 601/152 |
| 4,039,039 | A * | 8/1977 | Gottfried | 602/13 |
| 4,242,769 | A * | 1/1981 | Rayfield et al. | 441/91 |
| 6,317,893 | B1 * | 11/2001 | Walton | 2/227 |
| 7,721,352 | B1 * | 5/2010 | Swift | 2/82 |

* cited by examiner

*Primary Examiner* — Danny Worrell
*Assistant Examiner* — Khaled Annis
(74) *Attorney, Agent, or Firm* — Joseph M. Butscher; The Small Patent Law Group, LLC

(57) ABSTRACT

A system for providing a secure fit between feet and/or ankles of an individual and boot sections of wader pants may include wader pants including boot sections, and wader support pants configured to be positioned underneath or over the wader pants. The wader support pants may include inflatable membranes configured to be disposed within or on the boot sections of the wader pants, and a pump in fluid communication with the inflatable membranes. The pump is operable to inflate the membranes to provide a secure fit between the boot sections of the wader pants and the feet and/or ankles of the individual.

20 Claims, 3 Drawing Sheets

WADER PANTS SYSTEM WITH INFLATABLE MEMBRANES

BACKGROUND OF THE INVENTION

Embodiments generally relate to wader pants, and, more particularly, to a system and method for securely fitting wader pants to feet and/or ankles of an individual.

The sport and pastime of fishing may be practiced at various locations. Indeed, fishing may be much more than a sport or pastime, as many individuals are employed as commercial fishermen, for example. Some individuals fish at sea, while others fish within freshwater lakes, rivers, streams, or the like. In both environments, fishermen may fish off a dry platform, such off a dock or pier, or aboard a boat. Some fishermen prefer to directly wade into a stream and fish within the stream. For example, many fly-fishing enthusiasts prefer to fish within rivers and streams.

In order to maintain a dry lower body while fishing within a stream, river, or lake, many individuals wear wader pants. Hunters often also wear wader pants while hunting in wet areas. For example, duck hunters may lie in wait within duck blinds proximate lakes, streams, or the like where ducks congregate. Thus, wader pants may be used by fishermen, hunters, hikers, or anyone else that desires to wade through wet, muddy, or other such terrain.

Wader pants are generally formed of a water-impermeable substance, for example, rubber, and include boot portions integrally formed and connected with respective pant sections. Typical wader pants include suspenders connected to the waist of the wader pants. The suspenders ensure that the wader pants do not slide off an individual.

An individual wearing wader pants typically wades into a body of water to a depth that does not exceed the height of the wader pants on the wearer. For example, an individual wades into a stream such that the water level is below the waist of the individual. As such, the wader pants prevent water from infiltrating into the wader pants.

As can be appreciated, rivers, streams, swamps, lakes, wetlands, and the like may have muddy, sandy or otherwise sloppy beds or bases that may prove difficult to walk or otherwise traverse. Often, as an individual wades through a river, for example, the river bed moves around the individual's wader pant boot sections. The interaction of the river bed with the wader pant boot sections may produce a suction effect that tends to retain the boot sections within the river bed. As the individual continues to wade through the river bed, the suction effect may exert a retaining force into the boot sections, thereby making continued movement difficult. As the individual continues to attempt to walk over the river bed, the suction effect of the river bed may cause the individual's foot to slip within the wader pants, such that the individual's foot or feet retreat into pant sections of the wader pants. When an individual's feet retreat out of the boot sections of the wader pants, the individual may trip, or otherwise find walking difficult.

SUMMARY OF THE INVENTION

Certain embodiments provide a system for providing a secure fit between feet and/or ankles of an individual and boot sections of wader pants. The system may include wader pants including boot sections, and wader support pants configured to be positioned underneath or over the wader pants.

The wader support pants may include inflatable membranes integrally formed with the wader support pants and configured to be disposed within or on the boot sections of the wader pants, and a pump in fluid communication with the inflatable membranes.

The pump is operable to inflate the membranes to provide a secure fit between the boot sections of the wader pants and the feet and/or ankles of the individual.

The wader support pants may also include an air delivery system that fluidly connects the inflatable membranes to the pump. The air delivery system may include an inlet hose fluidly connected to leg hoses that fluidly connect to the inflatable membranes. The air delivery system may also include an extension hose fluidly coupling the leg hoses to the inlet hose.

The pump may be removably connected to the air delivery system. The pump may include an inflation bulb configured to be engaged to inflate the inflatable membranes and a deflation valve configured to be engaged to deflate the inflatable membranes.

The wader support pants may include a waist section connected to leg sections having ankle sections at distal ends. The inflatable membranes may be proximate the ankle sections. The inflatable membranes may include annular cuffs configured to surround one or both of the ankles or feet. Optionally, the inflatable membranes may include inflatable pouches configured to be positioned proximate heels of the individual.

The wader support pants may be wader lining pants configured to be positioned underneath the wader pants. Alternatively, the wader support pants may be wader cover pants configured to be positioned over the wader pants.

Certain embodiments provide support pants configured to provide a secure fit between feet and/or ankles of an individual and separate and distinct boot sections. The support pants may include a waist section integrally connected to leg sections, wherein ankle sections are located at distal ends of the leg sections. The support pants may also include inflatable membranes proximate the ankle sections, and a pump in fluid communication with the inflatable membranes through an air delivery system. The pump is operable to inflate the membranes to provide a secure fit between the boot sections and the feet and/or ankles of the individual.

Certain embodiments provide wader support pants configured to provide a secure fit between feet and/or ankles of an individual and boot sections of wader pants. The wader support pants may include a waist section integrally connected to leg sections. The ankle sections may be located at distal ends of the leg sections. The waist section and the leg sections may be configured to be positioned underneath the wader pants. The wader support pants may also include inflatable membranes proximate the ankle sections. The inflatable membranes may include inflatable pouches configured to be proximate heels of the individual, or annular cuffs configured to surround one or both of the ankles or feet. The wader support pants may also include a pump removably connected to an air delivery system secured in or on the wader support pants. The air delivery system may include an inlet hose fluidly connected to an extension hose fluidly connected to leg hoses that fluidly connect to the inflatable membranes. The pump is operable to inflate the membranes to provide a secure fit between the boot sections of the wader pants and the feet and/or ankles of the individual.

Figure 1:
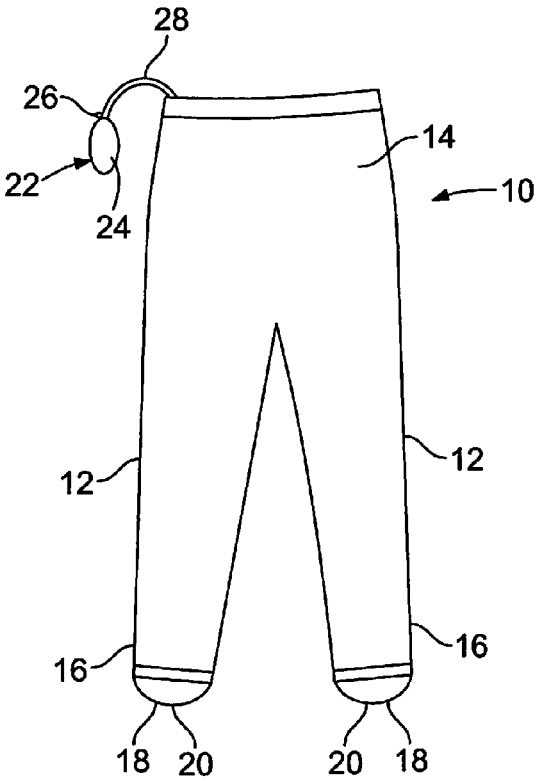
FIG. 1 illustrates a front view of wader support pants, according to an embodiment.

The foregoing summary, as well as the following detailed description of certain embodiments of the present invention, will be better understood when read in conjunction with the appended drawings. For the purpose of illustrating the invention, there are shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates a front view of wader support pants 10, according to an embodiment. The wader support pants 10 may be wader lining pants that are configured to be worn underneath a pair of wader pants, in order to provide a secure fit between an individual's feet, and boot sections of the water pants. Alternatively, the wader support pants 10 may be wader cover pants configured to be worn over a pair of wader pants, in order to provide a secure fit between an individual's feet, and boot sections of the wader pants. The wader support pants 10 may be formed of various materials, such as cloth, rubber, or the like.

The wader support pants 10 include leg sections 12 integrally connected to a waist section 14. Each leg section 12 includes an internal passage (not shown in FIG. 1) configured to allow an individual's leg to pass therein. An individual's foot passes out of an opening proximate an ankle section 16 of the leg section 12. A stirrup 18 may extend downwardly from each ankle section 16. Each stirrup 18 may be formed of a flexible piece of material, such as rubber, cloth, or the like. Distal portions 20 of the stirrups 18 are configured to be positioned underneath the feet of an individual to ensure that the leg sections 12 remain fully extended over the legs.

A pump 22 extends from the wader support pants 10 proximate the waist section 14. The pump 22 includes an inflation bulb 24 connected to a valve 26, which is, in turn, connected to a hose 28. The hose 28 is, in turn, removably connected to a connection port (not shown in FIG. 1) within or extending from the wader support pants 10. The connection port is, in turn, connected to an air delivery system within the wader support pants 10 that fluidly connects the pump 22 to inflatable membranes (not shown in FIG. 1) proximate the ankle sections 16 of the wader support pants 10.

In operation, an individual puts on the wader support pants 10 by inserting his/her legs through the waist section 14 and into the individual leg sections 12 until his/her feet engage the stirrups 18. Once the wader support pants 10 are on the individual, he/she puts wader pants over the wader support pants 10. In order to provide a secure fit between boot sections of the wader pants and the feet and/or ankles, an individual operates the pump 22 to inflate the inflatable membranes. After a desired fit is achieved, the individual may tuck the pump 22 into the wader support pants 10, or between the wader support pants 10 and the wader pants. Alternatively, the individual may remove the pump 22 at the connection port. For example, the pump 22 may threadably connect to the connection port. The individual may rotate the pump 22 relative to the connection port to remove the pump 22 from the connection port, which may include a valve, such as a check valve, that prevents air from escaping out of the connection port when the pump 22 is removed therefrom.

While the pump 22 is shown as a manual pump, the pump 22 may alternatively be an automatic air pump. For example, the pump 22 may include an air compressor and an actuator that may be automatically operated to deliver air to the inflatable membranes.

Figure 2:
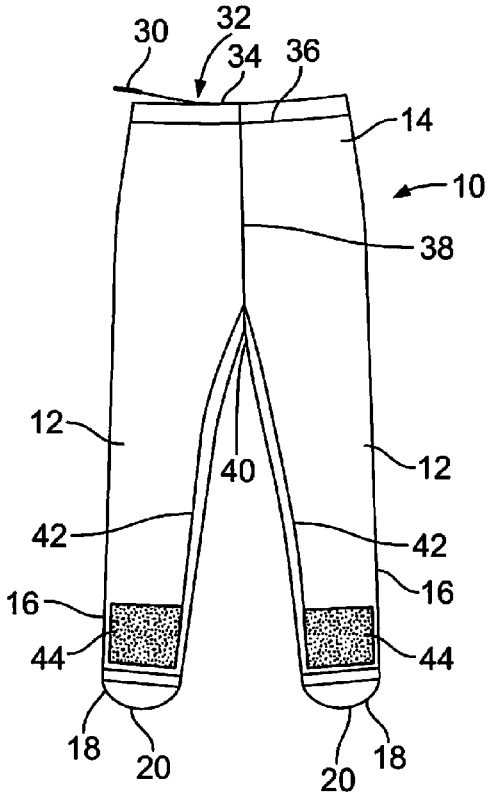
FIG. 2 illustrates a simplified internal view of wader support pants, according to an embodiment.

FIG. 2 illustrates a simplified internal view of the wader support pants 10, according to an embodiment. As noted above, the wader support pants 10 include a connection port 30 that connects to an air delivery system 32. The connection port 30 may be a coupling member, such as a threaded, latching, snapping, or other such coupling device that is configured to mate with a reciprocal member of the pump 22 (not shown in FIG. 2). The connection portion 30 includes an internal air passage that connects to the air delivery system 32. A valve, such as a check valve, may be disposed within the internal air passage, and configured to prevent air from escaping through the connection port 30 when the pump 22 is removed therefrom.

The air delivery system 32 may be formed of an air-tight material defining internal air passages. For example, the air delivery system 32 may be formed of rubber hoses. The air delivery system 32 includes an inlet hose 34 that connects to the connection port 30. The inlet hose 34 may be securely attached to interior portions of the wader support pants 10. For example, the inlet hose 34 may be integrally attached to interior portions of the wader support pants 10 through bonding, adhesives, fasteners, or the like. The inlet hose 34 may extend from the connection port 30, which may be proximate to the waist section 14, to a central internal area 36 of the wader support pants 10. Alternatively, the inlet hose 34 may extend from the connection port 30 down one of the leg sections 12. The inlet hose 34 integrally connects to an extension hose 38 that extends from the waist section 14 towards a crotch section 40 of the wader support pants 10. Proximate the crotch section 40, the extension hose 38 branches off into leg hoses 42 that extend over interior portions of the leg sections 12 and into inflatable membranes 44. Thus, the pump 22 and the air delivery system 32 are in fluid communication with the membranes 44.

The inflatable membranes 44 may be configured to be located behind an individual's feet, such as behind heels. In this manner, the inflatable membranes 44 may be inflatable pouches on or within the leg sections. Optionally, the inflatable membranes 44 may be configured to be positioned proximate toes, on top of feet, below feet, or at various other positions. Additionally, the inflatable membranes 44 may be annular cuffs that are configured to surround ankles of an individual. Optionally, the inflatable membranes 44 may be inflatable strips proximate the ankle sections 16 of the wader support pants 10. The inflatable membranes 44 may be formed of an air-tight material, such as an elastomeric material, rubber, or the like. Each inflatable membrane 44 is an air-tight, flexible membrane defining an internal air chamber. The air delivery system 32 allows air to be pumped into the inflatable membranes 44 in order to expand the membranes 44. Additionally, the air delivery system 32 is configured to allow the membranes 44 to be deflated.

As shown in FIG. 2, the air delivery system 32 may be positioned within the wader support pants 10. Alternatively, the air delivery system 32 and/or the inflatable membranes 44 may be positioned outside of the wader support pants 10. Additionally, the air delivery system 32 may be positioned at various other portions of the wader support pants 10. For example, the connection port 30 may be positioned along the leg sections 12. Also, the leg hoses 42 may branch from the inlet hose 34 proximate the waist section 14, instead of the crotch section 40. The air delivery system 32 may be positioned at the back or front of the wader support pants 10.

Further, while the inflatable membranes 44 are shown proximate the ankle sections 16 of the wader support pants 10, the inflatable membranes 44 may extend over greater lengths of the leg sections 12. For example, the inflatable membranes 44 may extend over an entire length of each leg section 12. Additionally, the wader support pants 10 may include integral foot sections, instead of the stirrups 18, connected to distal ends of the leg sections 12. The foot sections may be open- or closed-toed sections. The inflatable membranes 44 may extend into the foot sections. For example, the inflatable membranes 44 may extend through an entire length of the foot sections.

Figure 3:
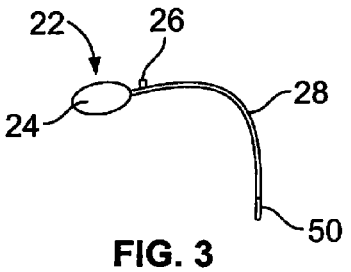
FIG. 3 illustrates a simplified view of a pump, according to an embodiment.

FIG. 3 illustrates a simplified view of the pump 22, according to an embodiment. The pump 22 includes the inflation bulb 24 connected to the valve 26, which is, in turn, connected to the hose 28. A reciprocal port 50 extends from a distal end of the hose 28. The reciprocal port 50 is configured to removably connect to the connection port 30 (shown in FIG. 2). The connection port 30 and the reciprocal port 50 may be configured to threadably, latchably, snapably, or otherwise removably engage one another. Alternatively, the hose 28 may integrally connect to the air delivery system 32 (shown in FIG. 2) without a removable connection. That is, the pump 22 may be permanently secured to the air delivery system 32.

Figure 4:
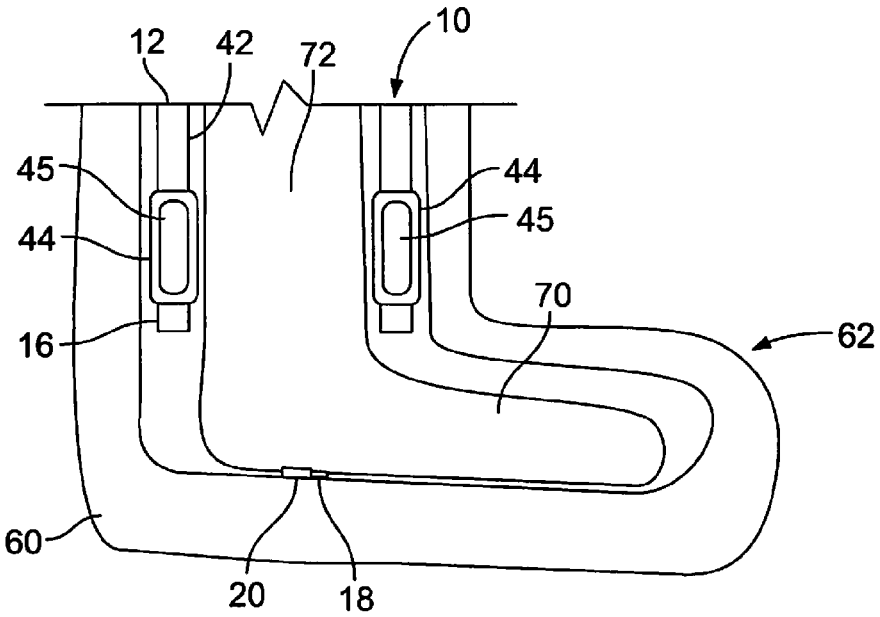
FIG. 4 illustrates a transverse cross-sectional view of a wader support pant leg section with a deflated membrane within a boot section of wader pants, according to an embodiment.

FIG. 4 illustrates a transverse cross-sectional view of a wader support pant leg section 12 with a deflated membrane 44 within a boot section 60 of wader pants 62, according to an embodiment. As shown, an individual's foot 70 extends through the ankle section 16 of the wader support pants 10. The distal portion 20 of the stirrup 18 is underneath the foot 70. As shown in FIG. 4, the ankle 72 may not be securely and snugly fit within the boot section 60 of the wader pants 62. Referring to FIGS. 1-4, in order to provide a secure, snug fit, the individual may operate the pump 22 in order to inflate the membranes 44, which include air chambers 45 configured to receive and retain air delivered from the air delivery system 32 by operation of the pump 22. For example, the individual may intermittently squeeze the pump 22 until a desired snug fit is achieved.

As shown in FIG. 4, the wader pants 62 may be separate and distinct from the wader support pants 10. Alternatively, the wader support pants 10 may be integrally formed with the wader pants 62. That is, the wader pants 62 may include inflatable membranes proximate ankle areas of the boot sections, and the inflatable membranes of the wader pants 62 may be operatively connected to an air delivery system, such as shown in FIG. 2. However, separate and distinct wader support pants 10 allow for use with any type of wader pant. That is, conventional wader pants may be retrofit with the wader support pants 10.

Figure 5:
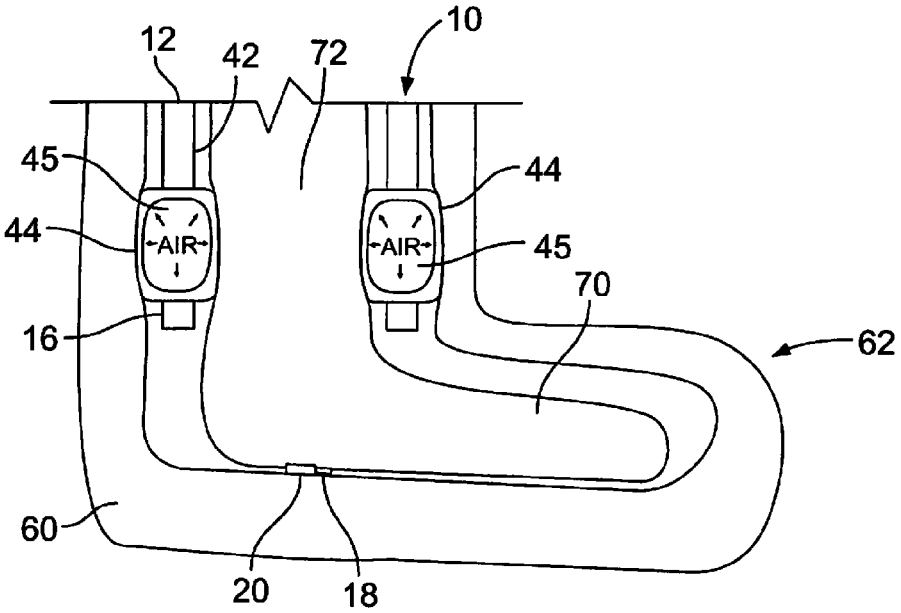
FIG. 5 illustrates a transverse cross-sectional view of a wader support pant section with an inflated membrane within a boot section of wader pants, according to an embodiment.

FIG. 5 illustrates a transverse cross-sectional view of the wader support pant section 12 with an inflated membrane 44 within the boot section 60 of the wader pants 62, according to an embodiment. As shown, the membranes 44 have been inflated, thereby providing a secure snug fit between the ankle 72 and the boot section 60 of the wader pants 62. The inflated membrane 44 is compressively sandwiched between an outer surface of the ankle 72 and an inner surface of the boot section 60 of the wader pants 62. As such, the ankle 72 and foot 70 are secured within the boot section 60. Therefore, the ankle 72 and foot 70 are prevented from retreating out of the boot section 60. The pump 22 may be engaged to inflate the membranes 44 of the wader support pants 10 when an individual enters wet, muddy, or otherwise sloppy terrain, such as within a river bed, swamp, marsh, or the like. By inflating the membranes 44, the boot sections 60 of the wader pants 62 securely and snugly engage the ankles 72 and/or feet 70, thereby ensuring that any suction effect of the terrain will not cause the feet to retreat out of the boot sections 60.

In order to deflate the membranes 44, the wearer may engage the valve 26 on the pump 22. For example, the valve 26 may be configured to be rotated into a deflation position that allows air within the membranes 44 and the air delivery system 32 to be released into the atmosphere.

As described above, the wader support pants 10 may be positioned inside or outside of the wader pants. For example, instead of expanding within the boot sections, the membranes 44 may ring around the boot sections and, during inflation, squeeze the boot sections into the ankle and/or feet. In this manner, the wader support pants may not line the wader pants, but may cover the wader pants.

Additionally, as noted above, the inflatable membranes 44 may cover and/or surround more portions of the individual's anatomy than shown in FIGS. 4 and 5. For example, the inflatable membranes 44 may surround the feet and ankles. Optionally, the inflatable membranes 44 may extend up to and past the knees, for example.

Figure 6:
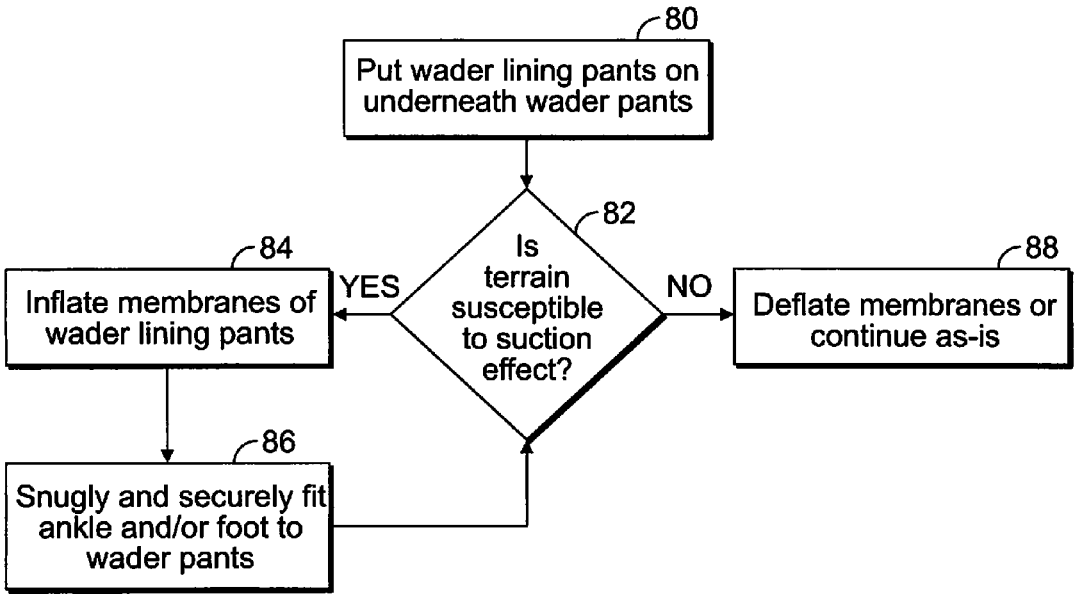
FIG. 6 illustrates a flow chart of operating wader support pants, according to an embodiment.

FIG. 6 illustrates a flow chart of operating wader support pants, according to an embodiment. At 80, an individual puts wader support pants on underneath wader pants. For example, the individual may first put on the wader support pants, and then the wader pants. Optionally, if the wader support pants are wader cover pants, the individual would put on the wader pants before the wader cover pants.

Next, at 82, the individual determines whether the terrain is susceptible to a suction effect. If yes, the process continues to 84, in which the individual inflates the membranes of the wader support pants. For example, the individual may intermittently squeeze a bulb of a pump that is in fluid connection with the membranes. Next, at 86, the individual's ankle and/or foot, for example, are snugly and securely fit to the wader pants through the inflation operation. The process then returns to 82.

If the terrain is not susceptible to a suction effect, at 88, the individual may deflate the membranes, or not deflate the membranes, depending on whether the individual prefers a tighter fit around his/her ankles. As explained above, the individual may deflate the membranes around his/her ankles by engaging a valve of the pump. Optionally, the deflation valve may be located anywhere on or within the air delivery system.

Referring to FIGS. 1-6, the wader lining pants have been described as being used with wader pants. However, the wader lining pants may also be used with boots, such as much-type boots worn by hunters, shoes, and various other forms of footwear in order to maintain a secure and snug fit between an individual's feet and the footwear. While the pants have been described as wader lining or cover pants, the pants may be used with any type of footwear, pants, or the like that are worn by hunters, fishermen, hikers, and the like. Thus, embodiments provide a system and method of ensuring that an individual's feet remain securely and snugly positioned within wader pants. Embodiments provide a system and method of inflating membranes of wader lining or cover pants to securely fit ankles and/or feet to boot sections of wader pants. Embodiments provide wader lining or cover pants that ensure that an individual's feet do not retreat out of boot sections of wader pants.

While various spatial and directional terms, such as top, bottom, lower, mid, lateral, horizontal, vertical, front and the like may be used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

The invention claimed is:

1. A system adapted to provide a secure fit between feet or ankles of an individual and boot sections of wader pants, the system comprising:

wader pants including a waist section integrally connected to leg sections and boot sections positioned at ankle sections, wherein the ankle sections are located at distal ends of the leg sections; and wader support pants coextensive and be positioned underneath or over the wader pants, wherein the wader support pants comprise:

inflatable membranes integrally formed with the wader support pants, wherein the inflatable membranes are disposed within or on the boot sections of the wader pants; and a pump in fluid communication with the inflatable membranes, wherein the pump is adapted and operable to inflate the membranes to provide a secure fit between the boot sections of the wader pants and the feet or ankles of the individual.

2. The system of claim 1, wherein the wader support pants further comprise an air delivery system that fluidly connects the inflatable membranes to the pump.

3. The system of claim 2, wherein the air delivery system comprises an inlet hose fluidly connected to leg hoses that fluidly connect to the inflatable membranes.

4. The system of claim 3, wherein the air delivery system further comprises an extension hose fluidly coupling the leg hoses to the inlet hose.

5. The system of claim 2, wherein the pump is removably connected to the air delivery system.

6. The system of claim 1, wherein the wader support pants comprise a waist section connected to leg sections having ankle sections at distal ends, and wherein the inflatable membranes are proximate the ankle sections.

7. The system of claim 1, wherein the inflatable membranes comprise annular cuffs configured to surround one or both of the ankles or feet.

8. The system of claim 1, wherein the wader support pants are wader lining pants configured to be positioned underneath the wader pants.

9. The system of claim 1, wherein the pump comprises an inflation bulb configured to be engaged to inflate the inflatable membranes and a deflation valve configured to be engaged to deflate the inflatable membranes.

10. Support pants configured to provide a secure fit between feet or ankles of an individual and separate and distinct boot sections, the support pants comprising:

wader pants coextensive with the support pants and positioned underneath or over the support pants a waist section integrally connected to leg sections, wherein ankle sections are located at distal ends of the leg sections;

inflatable membranes integrally formed with the ankle sections; and a pump in fluid communication with the inflatable membranes through an air delivery system, wherein the pump is adapted and operable to inflate the membranes to provide a secure fit between the boot sections and the feet or ankles of the individual.

11. The support pants of claim 10, wherein the air delivery system comprises an inlet hose fluidly connected to leg hoses that fluidly connect to the inflatable membranes.

12. The support pants of claim 11, wherein the air delivery system further comprises an extension hose fluidly coupling the leg hoses to the inlet hose.

13. The support pants of claim 10, wherein the pump is removably connected to the air delivery system.

14. The support pants of claim 10, wherein the pump extends from the waist section.

15. The support pants of claim 10, wherein the inflatable membranes comprise annular cuffs configured to surround one or both of the ankles or feet.

16. The support pants of claim 10, wherein the inflatable membranes comprise inflatable pouches configured to be positioned proximate heels of the individual.

17. The support pants of claim 10, wherein the support pants are wader lining pants configured to be positioned underneath wader pants.

18. The support pants of claim 10, wherein the pump comprises an inflation bulb configured to be engaged to inflate the inflatable membranes and a deflation valve configured to be engaged to deflate the inflatable membranes.

19. Wader support pants configured to provide a secure fit between feet or ankles of an individual and boot sections of wader pants, the wader support pants comprising:

wader pants coextensive with the wader support pants and positioned underneath or over the wader support pants a waist section integrally connected to leg sections, wherein ankle sections are located at distal ends of the leg sections, wherein the waist section and the leg sections are positioned underneath the wader pants;

inflatable membranes integrally formed with the ankle sections; and a pump removably connected to an air delivery system secured in or on the wader support pants, wherein the air delivery system comprises an inlet hose fluidly connected to an extension hose fluidly connected to leg hoses that fluidly connect to the inflatable membranes, wherein the pump is adapted and operable to inflate the membranes to provide a secure fit between the boot sections of the wader pants and the feet or ankles of the individual.

20. The wader support pants of claim 10, wherein the inflatable membranes comprise one or both of inflatable pouches configured to be positioned proximate heels of the individual or annular cuffs configured to surround one or both of the ankles or feet.

* * * * *